United States Patent [19]

Takahara et al.

[11] Patent Number: 4,523,189

[45] Date of Patent: Jun. 11, 1985

[54] EL DISPLAY DEVICE

[75] Inventors: Kazuhiro Takahara, Kawasaki; Keizo Kurahashi, Sagamihara; Hiroyuki Gondo, Kobe; Kenichi Oki, Takarazuka; Shoshin Miura, Kobe, all of Japan

[73] Assignee: Fujitsu Limited, Kawasaki, Japan

[21] Appl. No.: 380,698

[22] Filed: May 21, 1982

[30] Foreign Application Priority Data

May 25, 1981 [JP] Japan ..... 56-80307
Feb. 23, 1982 [JP] Japan ..... 57-29634

[51] Int. Cl.[3] ..... G09G 3/30

[52] U.S. Cl. ..... 340/781; 307/318; 357/13; 340/719

[58] Field of Search ..... 340/781, 718, 719, 813; 307/318, 200 B; 357/13, 20, 41, 45

[56] References Cited

U.S. PATENT DOCUMENTS

| | | | |
|---|---|---|---|
| 3,673,428 | 6/1972 | Athanas | 307/200 B X |
| 3,754,171 | 8/1973 | Anzai et al. | 307/200 B X |
| 3,936,863 | 2/1976 | Olmstead | 307/318 X |
| 4,115,709 | 9/1978 | Inove et al. | 307/200 B X |
| 4,171,492 | 10/1979 | Burth | 307/318 X |

OTHER PUBLICATIONS

Proceedings of the Sid, "Thin-Film Transistor Switching of Thin-Film Electro-Luminescent Display Elements", by Kun et al., vol. 21/2, 1980, pp. 85-91.

"A New Recipe for Viewability: Thin Film EL+Black Layer+The TFT", by K. O. Fugate, Thin Film Devices Laboratory, pp. 20-28.

Society for Information Display, "Active Matrix Addressing Techniques", by John E. Gunther, Session S-1, pp. 1-34.

*Primary Examiner*—Marshall M. Curtis
*Assistant Examiner*—Vincent P. Kovalick
*Attorney, Agent, or Firm*—Staas & Halsey

[57] ABSTRACT

A thin-film EL display device incorporates a MOS active matrix. Each of the MOS transistor arrays is additionally provided in parallel with a Zener diode for the purpose of protecting the device from a high voltage. This Zener diode has a breakdown voltage characteristic corresponding to a difference between a luminous voltage and a non-luminous voltage of an EL display element and clamps the voltage across the MOS transistor, in the "OFF" state, to a voltage less than or equal to non-recoverable breakdown voltage.

8 Claims, 18 Drawing Figures

Fig. 1
(PRIOR ART)
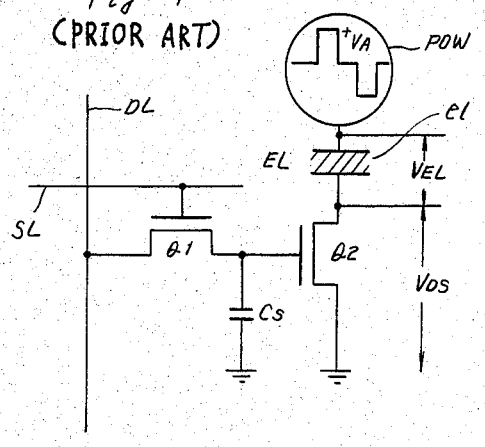
Fig. 2 (a)
(POW) 0[V]
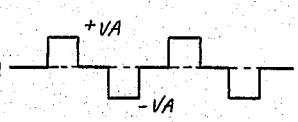
Fig. 3 (a)
(POW) 0[V]
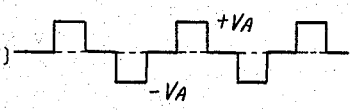
Fig. 2 (b)
(VDS) 0[V]
Fig. 3 (b)
(VDS) 0[V]
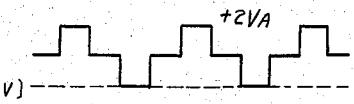
Fig. 2 (C)
(VEL) 0[V]
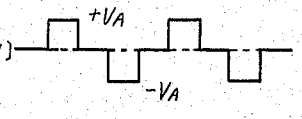
Fig. 3 (C)
(VEL) 0[V]
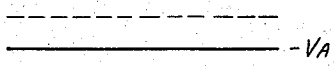

Fig. 7
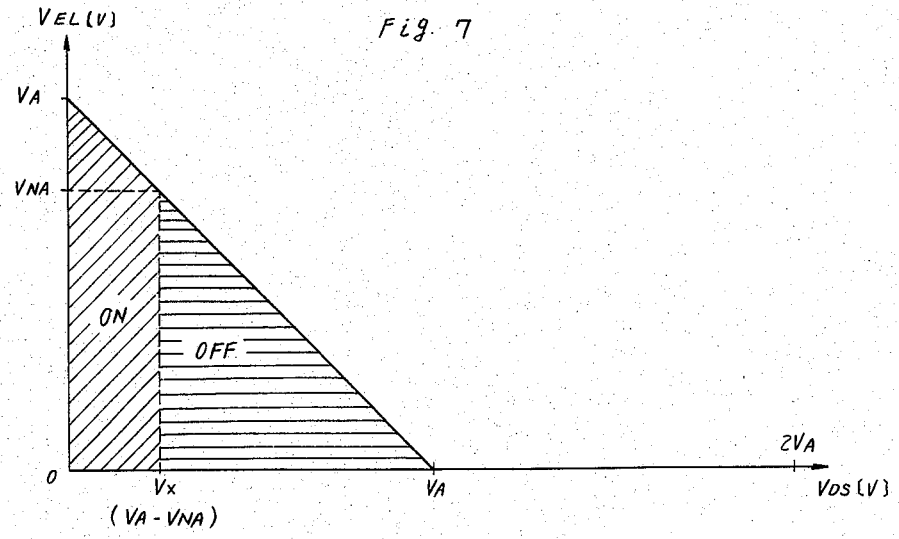
Fig. 8 (a) (POW)
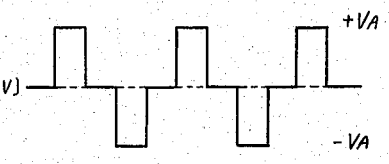
Fig. 8 (b) (VDS)
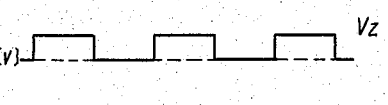
Fig. 8 (C) (VEL)
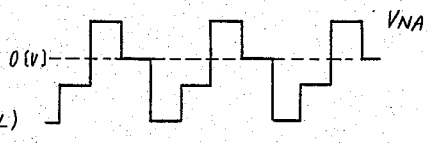
Fig. 11 (a)
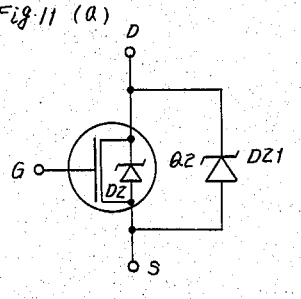
Fig. 11 (b)
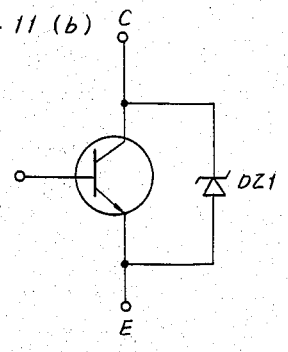

EL DISPLAY DEVICE

BACKGROUND OF THE INVENTION

1. Field of the Invention

This invention relates to an EL display device, particularly to a new version of a MOS-EL integrated display device providing a protection means to a MOS switching element which forms an active matrix for combining the EL display elements.

2. Description of the Prior Art

Recently a device combining a thin-film electro luminescent (EL) phosphor and the active matrix array driver has been developed in the display field. For example, the thesis entitled "THIN-FILM TRANSISTOR SWITCHING OF THIN-FILM ELECTROLUMINESCENT DISPLAY ELEMENTS" presented on the Proceedings of SID, Vol. 21/2, 1980, PP. 85–90 by Z. K. Kun et al. introduces a display device combining a thin-film EL phosphor on the integrated active matrix addressing circuit substrate having a thin-film transistor (TFT) structure.

FIG. 1 is an equivalent circuit of a typical display element of the existing EL display comprising the abovementioned TFT technology. The data line DL is connected to the drain terminal of the first switching element $Q_1$ comprising a MOS FET, while the scanning line SL is connected to the gate terminal of transistor $Q_1$. The source terminal of transistor $Q_1$ is connected to the gate terminal of the second switching element $Q_2$ comprising a MOS FET and is also connected to the capacitor $C_s$ for data accumulation. The drain terminal of transistor $Q_2$ is connected to a first electrode of the display element EL. The source terminal of transistor $Q_2$ is connected to ground as the reference voltage. The display element EL has the thin-film structure which sandwiches the EL phosphor layer el, such as ZnS:Mn, via an insulating film (not illustrated) between two electrodes. An AC voltage pulse is supplied to a second electrode of the display element EL from the power supply POW.

When a scanning pulse signal having the specified width is supplied to the scanning line SL under the condition that the data line DL is set to a logical "1" in order to bring the display element EL into the display condition, the transistor $Q_1$ becomes "ON" and the capacitor $C_s$ accumulates charges corresponding to the scanning signal. Thereby, the transistor $Q_2$ becomes "ON" and a voltage between the drain and source of transistor $Q_2$ becomes almost 0 V. Since an AC voltage $\pm V_A$, as shown in FIG. 2 (*a*), is supplied to the first electrode from the power supply POW and the second electrode of the display element EL is clamped to ground as shown in FIG. 2 (*b*) through the transistor $Q_2$, the supply voltage of $\pm V_A$ is applied across the opposing electrodes of display element EL as shown in FIG. 2 (*c*) and thereby the display element is brought into the display condition. On the other hand, when the transistor $Q_2$ becomes "OFF" because the capacitor $C_s$ *discharges, transistor* $Q_2$ becomes equivalent to a diode. Therefore the voltage $\pm V_A$ supplied from the power supply POW as shown in FIG. 3 (*a*) is accumulated in the display element EL which acts as a capacitor. As a result, the drain voltage $V_{DS}$ of $Q_2$ changes as much as $2V_A$ as shown in FIG. 3 (*b*). But, the voltage $V_{EL}$ applied across both electrodes of the display element EL becomes the DC voltage of these voltages. Therefore, when the transistor $Q_2$ is "OFF", the AC driven display element EL does not emit light.

However, as is obvious from the above explanation, when the transistor $Q_2$ is "OFF", a voltage of $2V_A$ is applied across the source and drain of the transistor, requiring a very high breakdown voltage of the transistor $Q_2$. Since an actual EL drive voltage $V_A$ is selected, as an example, to be about 160 V (320 V peak to peak), the transistor $Q_2$ is required to have a breakdown voltage of about 320 V. A MOS transistor having such a high breakdown voltage can be obtained as a discrete element, but it is considerably difficult to obtain, on a commercial basis, an integrated MOS active matrix for combining the EL display.

For example, according to J. E. Gunther's proposal indicated on page 30 of SID SESSION S-1 "ACTIVE MATRIX ADDRESSING TECHNIQUES" of Seminar Lecture Notes, Apr. 28, 1980, as a means for solving such a problem, a second capacitor acts as an AC voltage divider which biases the display element just below its threshold and is provided in parallel with the driver transistor $Q_2$ providing the TFT structure. However, the addition of such a second capacitor to the signal accumulation capacitor $C_s$ requires complicated multilayer techniques for configuring the capacitor, resulting in a problem that the degree of integration of elements is restricted.

SUMMARY OF THE INVENTION

It is a primary object of this invention to attain technical matching between the EL display element, which requires a comparatively high drive voltage, and the active switching elements which have a low breakdown voltage upon incorporating the active matrix addressing circuit and the EL display elements, and to protect the active switching element, having a simple structure, from non-recoverable breakdown due to a high drive voltage.

It is another object of this invention to offer a MOS-EL integrated display device using a silicon substrate which can be fabricated easily and with high reliability.

Briefly, this invention is characterized by setting the breakdown voltage of the switching transistor element, which is connected to the EL display element, to the difference between the luminous voltage and non-luminous voltage of the display element. The "OFF" voltage applied to the transistor element is clamped to a value less than or equal to the non-recoverable breakdown voltage.

In particular, the EL display device of the present invention comprises a semiconductor substrate, a plurality of display electrodes corresponding to picture elements arranged on the semiconductor substrate the opposing electrodes of the display electrodes are arranged across the EL layer. The EL display device also provides switching transistor elements on the semiconductor substrate for selectively driving the display electrodes corresponding to picture elements. The p-n junction, which is formed between the electrodes connected to the display electrodes of the switching transistors and the semiconductor substrate, breaks down at a voltage which is equal to the difference between the luminous voltage and non-luminous voltage of the EL layer. The p-n junction forms the a Zener diode connected in parallel with the switching transistor element and clamps the voltage across the transistor element in the "OFF" state to a voltage less than or equal to the non-recoverable breakdown voltage of the relevant element. It is desirable to form the p-n junction which functions as a Zener diode, as the junction between the drain region and substrate of the switching MOS transistor, but an independent diode element can be integrated for this purpose. In addition, the breakdown voltage of the p-n junction is set to a voltage greater than the difference between the luminous voltage and the maximum non-luminous voltage, thereby biasing the EL display element to a voltage lower than the maximum non-luminous voltage in the "OFF" condition.

BRIEF DESCRIPTION OF THE DRAWINGS

FIG. 1 is a prior art circuit of an element of the EL display incorporating an active matrix;

FIG. 2 (*a*), FIG. 2(*b*) and FIG. 2 (*c*) are waveforms of the power supply voltage, the drain voltage of the switching element $Q_2$ in FIG. 1 in the "ON" state and a voltage applied to the EL display element, respectively;

FIG. 3 (*a*), FIG. 3 (*b*) and FIG. 3 (*c*) are waveforms of the power supply voltage, the drain voltage of the switching element $Q_2$ in FIG. 1 in the "OFF" state, and a voltage applied to the EL display element, respectively;

FIG. 7 is a graph indicating the relation between the source-drain voltage $V_{DS}$ of the transistor $Q_2$ and a voltage $V_{EL}$ applied to the display element EL in the circuit of FIG. 6;

FIG. 8 (*a*), FIG. 8 (*b*) and FIG. 8 (*c*) are waveforms of the power supply voltage, the drain voltage of the transistor $Q_2$ of FIG. 6 in the "OFF" state, and a voltage applied to the EL display element, respectively;

FIG. 11 (*a*) and FIG. 11 (*b*) are circuit structures of a second and third embodiment, respectively.

DESCRIPTION OF THE PREFERRED EMBODIMENTS

Figure 4:
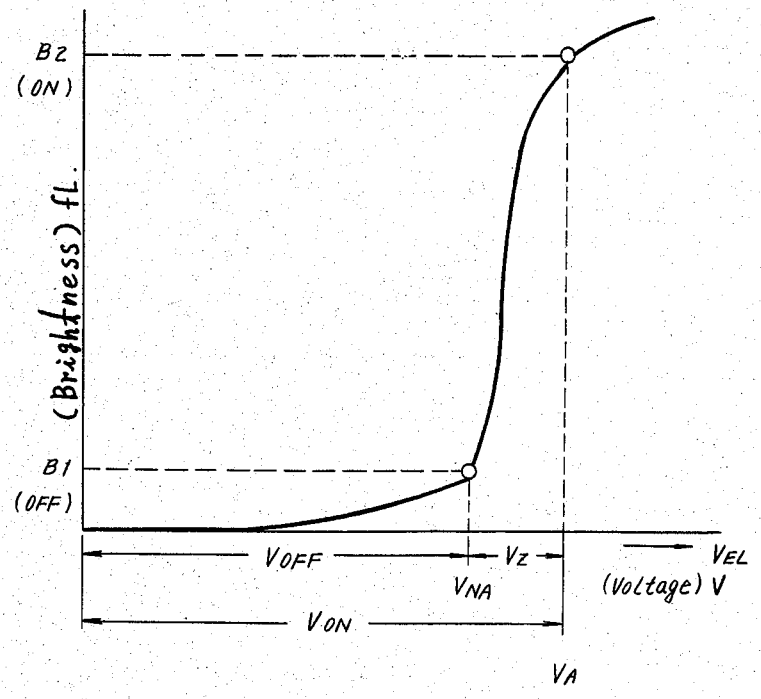
FIG. 4 is a graph of the voltage vs. brightness characteristic of the EL display element of FIG. 1.

A typical voltage-brightness characteristic of the thin-film EL display is shown in FIG. 4. As will be obvious from the characteristic curve of FIG. 4, the thin-film EL display element cannot assure sufficient brightness as high as that detected by eyes even when the voltage applied is boosted up to a comparatively high voltage, $V_{NA}$, but has a characteristic where the brightness sharply rises from B1 to B2 due to a voltage change from $V_{NA}$ to $V_A$. The display element can be considered as being the non-luminous condition or "OFF" state until the brightness level reaches B1 which generally corresponds to about 1 fL. A voltage $V_{NA}$ which gives a brightness level of B1 can be considered as the display threshold voltage or the maximum non-luminous voltage and a voltage, up to $V_{NA}$ can be defined as the non-luminous voltage or "OFF" voltage $V_{OFF}$. On the other hand, the brightness level B2 which is sufficient for the "ON" state is generally 20 fL or higher and a voltage $V_A$ which gives a brightness level of the "ON" state is defined as the luminous voltage or "ON" voltage $V_{ON}$.

This invention is based on the voltage-brightness characteristic of the EL display element. The non-luminous voltage up to $V_{NA}$ is always applied to the display element and the "ON," "OFF" status of the display element is controlled by switching between the luminous voltage $V_{ON}$ and non-luminous voltage $V_{OFF}$ with the transistor for selectively driving the display element. In order to attain such operation, the present invention provides a clamping diode, having the breakdown voltage $V_Z$ satisfying the relation of $V_Z \geqq V_A - V_{NA}$, in parallel with the transistor for selectively driving the display element and connected in series with the EL display element.

Figure 5:
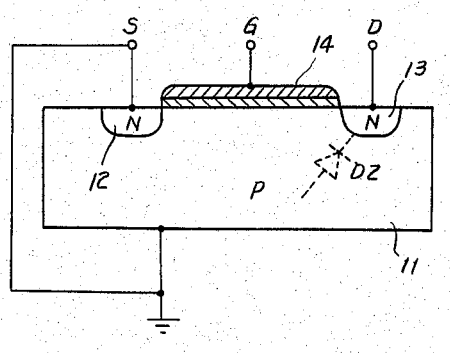
FIG. 5 is a schematic diagram of the structure of the MOS FET used as the switching transistor element in the present invention.

FIG. 5 schematically shows the sectional view of the N channel MOS transistor used in the present invention in place of the TFT type switching transistor $Q_2$ shown in FIG. 1. It is well known that the diode $D_Z$, as shown in the figure, is formed at the junction area of the drain region 13 and substrate 11 when the source region 12 and drain region 13 are formed by diffusing an n type impurity into the p type silicon substrate 11. Therefore, when the N channel MOS transistor is in the "ON" state because the predetermined voltage is applied to the gate terminal G provided on the insulating film 14, the diode $D_Z$ can be ignored. But when the N-channel MOS transistor is in the "OFF" state, the diode $D_Z$ cannot be ignored.

Figure 6:
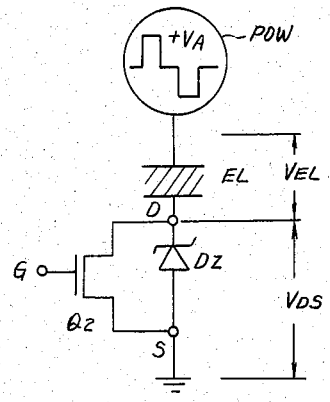
FIG. 6 is a circuit diagram of of the MOS-EL integrated display device the invention.

FIG. 6 shows an equivalent circuit of the display device considered in the case where the source terminal S and substrate are grounded, the drain terminal D is connected to the display element EL and the FET is in the "OFF" state. It is a characteristic of the present invention that the display element EL can be grounded via the backward diode $D_Z$, and the clamping function of the constant voltage characteristic of this diode $D_Z$ can be utilized considering it as a Zener diode and not just as the backward diode.

FIG. 7 shows the characteristic curve of the relation between the drain-source voltage $V_{DS}$ of the drive transistor $Q_2$ and a voltage $V_{EL}$ which is applied across the display element EL when the power supply POW becomes positive. The horizontal axis represents the voltage $V_{DS}$, while the vertical axis represents the voltage $V_{EL}$. When $Q_2$ is "ON" and the voltage $V_{DS}$ is 0V, a voltage $V_A$, for example, 160 V is applied across the display element EL. As a result, the element EL emits light at a brightness B2 of 20 to 30 fL, resulting in the display being in the ON state. However, when a voltage applied to the diode $D_Z$ increases and the voltage $V_{DS}$ becomes $V_X$, a voltage $V_{EL}$ applied to the display element EL becomes $V_{NA}$, and the brightness decreases to the level B1, for example, about 1 fL, resulting in the display being in the "OFF" state which cannot be detected visually. Moreover, when the voltage $V_{DS}$ increases, the positive voltage $V_{EL}$ is applied to the display element EL at such a timing that $V_{DS}$ becomes equal to $V_A$ which is 0V.

Here, when the relation $V_X = V_A - V_{NA}$ exists, and the drain-source voltage $V_{DS}$ ranges from 0V to $V_X$ while the transistor $Q_2$ is "OFF", a voltage of $V_{NA}$ or higher is applied to the display element EL and the display element is in the "ON" state. However, if the voltage $V_{DS}$ is a value higher than $V_X$, a voltage applied to the diode $D_Z$ increases and a voltage $V_{EL}$ applied to the display element becomes $V_{NA}$ or lower. Thus the display element is in the "OFF" state. Therefore, even when the breakdown voltage $V_Z$ of the diode $D_Z$ is not higher than the voltage $2V_A$, the non-luminous state can be obtained when the transistor $Q_2$ is "OFF". Namely, the breakdown voltage $V_Z$ can be set to a value smaller than $2V_A$ and higher than $V_X$ within the operating voltage range. A smaller breakdown voltage $V_Z$ is desirable for fabrication and it is more desirable to set it to a value equal to $V_A-V_{NA}$ or a little higher.

Respective waveforms, when $V_Z$ is set to a value as indicated above and the driver transistor $Q_2$ is in an "OFF" state, are shown in FIGS. 8 (*a*), (*b*), and (*c*). FIG. 8 (*a*) is a waveform of the signal supplied from the power supply POW and FIG. 8 (*b*) is a waveform of the voltage $V_{DS}$ across the drain and source of transistor $Q_2$. FIG. 8 (*c*) is a waveform of the voltage $V_{EL}$ applied across the display element EL in the "OFF" state. As an example, since $V_A$ is 160 V and $V_{NA}$ is 125 V, $V_Z$ is set to about 40 V.

Therefore, in this case, a voltage across the transistor $Q_2$ is clamped to about 40 V and a voltage of 40 V or a little higher is sufficient as the breakdown voltage of $Q_2$. The MOS transistor having such a breakdown voltage can be easily integrated by the fabrication process which is now explained.

Figure 9:
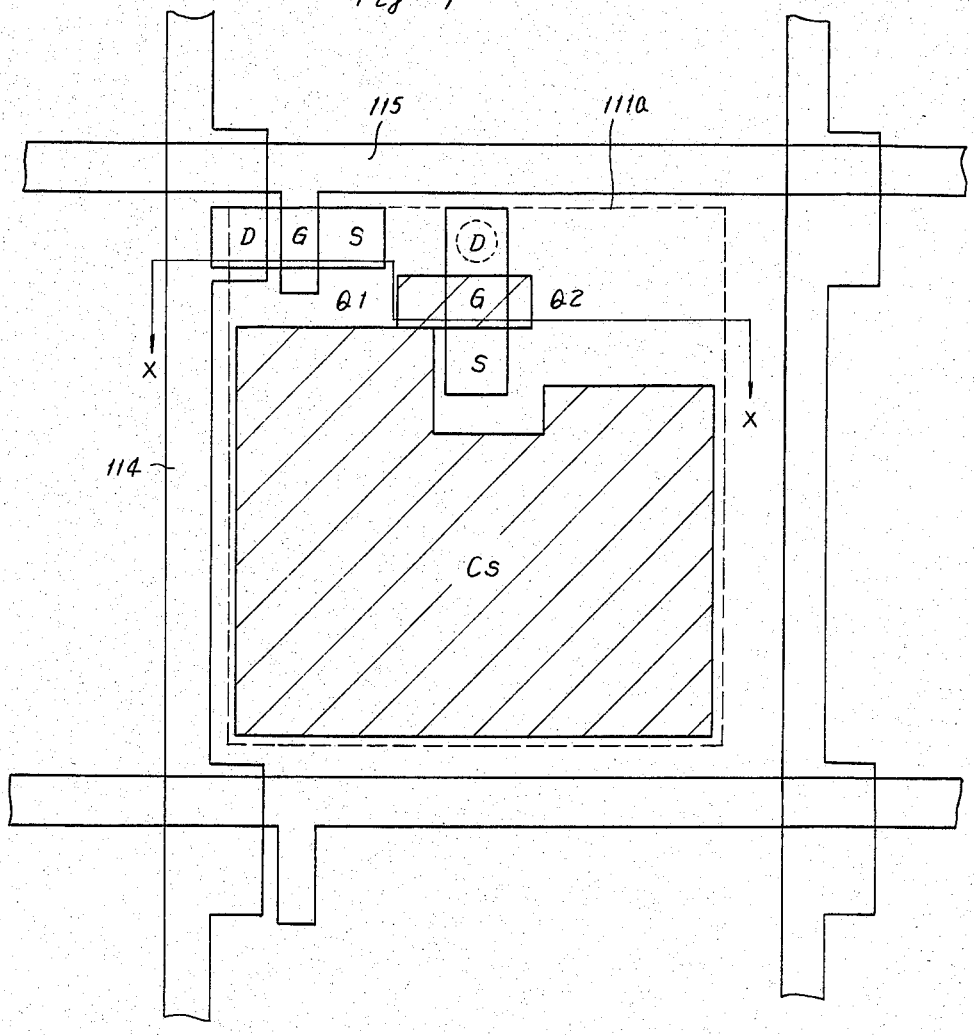
FIG. 9 is a plan view of the electrode layout of an element of the EL display device incorporating the active matrix of the present invention.
Figure 10:
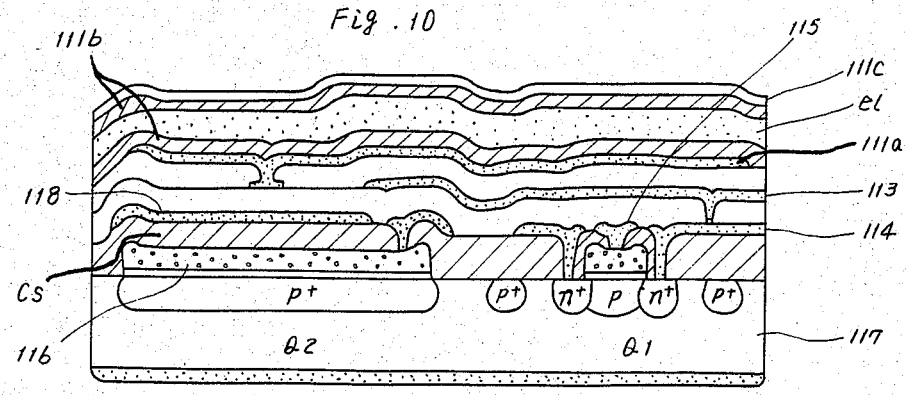
FIG. 10 is a sectional view taken along the line X—X of FIG. 9.

FIG. 9 and FIG. 10 are examples of the EL display element arranged in the form of an active matrix circuit for driving the semiconductor display device. FIG 9 is a plan view of the element and FIG. 10 is a sectional view of the element along the line X—X.

On the silicon substrate 117, the transistors $Q_1$, $Q_2$, capacitor $C_s$ and display element EL are formed in a multilayered structure. The display element EL comprises a display electrode 111*a* which is independent of each element, thin-film EL phosphor el comprising ZnS:Mn sandwiched on both sides by an insulating film 111*b* like $Y_2O_3$, and a transparent electrode common to all elements (ITO film) 111*c*. The conductor 114 for the data line is input to the drain terminal D of transistor $Q_1$, while the conductor 115 for the scanning line is input to the gate terminal G of transistor $Q_1$. The electrode 116 is used in common as the gate terminal G of transistor $Q_2$ and the one electrode of capacitor $C_s$, and the capacitor $C_s$ is composed of the electrodes 116 and 118. The conductor 113 works as the shielding electrode.

Here, the clamping diode element having the breakdown voltage is considered since the MOS type FET provides the diode function between the drain region and the substrate. Therefore, it is enough to set the breakdown voltage $V_Z$ to that of the p-n junction as explained above. In this case, the MOS type FET employed for the switching function may employ either an N type or P type FET in the channel structure since positive and negative (bipolar) pulses are used as the driving source voltage. The voltage $V_Z$ can be controlled by adjusting the impurity concentration and depth when forming the drain region for the substrate. In the case of a P channel MOS, the direction of the diode is naturally inverted for the embodiment shown in FIG. 6.

Meanwhile, it is also possible, as shown in FIG. 11 (*a*), to externally connect a diode element $D_{Z1}$ between the drain terminal D and source terminal S without using the rectification function which the MOS type FET has and to set the breakdown voltage $V_Z$ of this diode $D_{Z1}$ to the specified value in accordance with the present invention. In addition, when a bipolar transistor is used as in the case of FIG. 11 (*b*), the diode element $D_{Z1}$ can also be connected externally between the collector terminal C and emitter terminal E.

As is obvious from the above explanation, according to the present invention, the breakdown voltage required for the switching transistor can be reduced by providing a Zener diode in parallel to the switching transistor for selectively driving the EL display element and by setting such breakdown voltage $V_Z$ to be the difference between the luminous voltage and non-luminous voltage of the EL display element. Therefore, application of the present invention to the EL display device integrating the active matrix makes it easy to fabricate the MOS switching transistor through integration and to supply at a low cost a highly reliable device. Moreover, this invention is advantageous in the case of constructing a modular type display device, such as proposed by T. Unotoro et al in U.S. patent Application Ser. No. 236,621 assigned to the same assignee of this invention. Now U.S. Pat. No. 4,368,467.

We claim:

1. An EL display device having an EL layer having a luminous voltage level for activating an electroluminescent phosphor and a non-luminous voltage level and picture elements, formed on a semiconductor substrate, comprising:

a plurality of display electrodes, corresponding to the picture elements, arranged on the semiconductor substrate; and switching transistors, formed on the semiconductor substrate and respectively, operatively connected to said plurality of display electrodes, for selectively driving the respective display electrodes corresponding to the picture elements, each of said switching transistors having a p-n junction with a breakdown voltage equal to a voltage difference between the luminous voltage level and non-luminous voltage level of the EL layer.

2. An EL display device as claimed in claim 1, wherein each of said switching transistors comprises a MOS transistor having a drain region, for providing the p-n junction between the drain region and semiconductor substrate, said p-n junction having the breakdown voltage which is equal to the difference between the luminous voltage level and non-luminous voltage level of the EL layer.

3. An EL display device as claimed in claim 1, wherein the p-n junction forms a Zener diode having the breakdown voltage equal to the difference between the luminous voltage level and non-luminous voltage level of the EL layer.

4. An EL display device, operatively connected to receive a reference voltage, comprising:

a display element, having first and second electrodes, having a luminous voltage level for activating an electroluminescent phosphor between said first and second electrodes, and having a non-luminous voltage level;

a power supply, operatively connectable to said display element, for supplying an AC voltage having a peak value of $V_A$ which is sufficient to provide the luminous voltage level to said first electrode to turn on said display element;

a switching element, operatively connected to said second electrode of said display element and operatively connected to receive the reference voltage, wherein the luminous and non-luminous voltage levels of said display element are controlled by controlling a voltage applied across said first and second electrodes of said display element by means of said switching element;

a diode element having a breakdown voltage $V_Z$, operatively connected to said second electrode of said display element and operatively connected to receive the reference voltage, the voltage across said switching element being clamped to a voltage lower than the breakdown voltage $V_Z$ of said diode element by setting the breakdown voltage $V_Z$ of said diode element to be within the range, $$V_A - V_{NA} \leqq V_Z 21\ 2V_A$$

(where $V_{NA}$ is the maximum voltage for maintaining the non-luminous voltage level).

5. An EL display device as claimed in claim 4, wherein said switching element is a MOS type transistor and wherein said diode element is formed as a junction between the drain region and semiconductor substrate of said MOS type transistor.

6. An EL display device as claimed in claim 4 or 5, wherein the breakdown voltage $V_Z$ of said diode element is set to a voltage which is substantially equal to the difference between the voltage $V_A$ which is supplied to drive said display element into the luminous state and the maximum non-luminous voltage $V_{NA}$ of said display element.

7. An EL display device as claimed in claim 4, further comprising a plurality of display elements, a plurality of diode elements and a plurality of switching elments, wherein the EL display device is formed on a semiconductor substrate, wherein the plurality of said display elements and the plurality of said switching elements incorporating the plurality of said diode elements, are integrated on the semiconductor substrate.

8. An EL display device operatively connectable to receive a reference voltage and a power supply, the display device comprising:

a display element having a luminous and non-luminous voltage state, having a first electrode operatively connected to the power supply and having a second electrode, for activating an electroluminescent phosphor between said first and second electrodes;

a switching element having a luminous and non-luminous voltage, operatively connected to said second electrode and operatively connected to receive the reference voltage, for providing one of the luminous voltage and the non-luminous voltage to said display element; and a diode element having a breakdown voltage, operatively connected to said second electrode and operatively connected to receive the reference voltage, for clamping the voltage of said switching element to a voltage lower than the breakdown voltage of said switching element, the breakdown voltage of said diode element being greater than or equal to the difference between the power supply voltage and the maximum non-luminous voltage state and less than twice the power supply voltage.

* * * * *

UNITED STATES PATENT AND TRADEMARK OFFICE

CERTIFICATE OF CORRECTION

PATENT NO. : 4,523,189

DATED : JUNE 11, 1985

INVENTOR(S) : KAZUHIRO TAKAHARA ET AL.

It is certified that error appears in the above-identified patent and that said Letters Patent is hereby corrected as shown below:

Col. 2, line 64, delete "the".

Col. 3, line 29, delete "of" (second occurrence).

Col. 7, line 12, "$V_Z21$" should be --$V_Z$<--.

Signed and Sealed this

*Eighth* Day of *October 1985*

[SEAL]

*Attest:*

DONALD J. QUIGG

*Attesting Officer*

*Commissioner of Patents and Trademarks—Designate*